United States Patent [19]

Blum

[11] 4,280,691

[45] Jul. 28, 1981

[54] SHEET FEEDING DEVICE

[75] Inventor: Herbert Blum, Wiesbaden-Schierstein, Fed. Rep. of Germany

[73] Assignee: Hoechst Aktiengesellschaft, Frankfurt am Main, Fed. Rep. of Germany

[21] Appl. No.: 922,746

[22] Filed: Jul. 7, 1978

[30] Foreign Application Priority Data

Jul. 9, 1977 [DE] Fed. Rep. of Germany ..... 2731095

[51] Int. Cl.[3] ..... B65H 3/12

[52] U.S. Cl. ..... 271/11; 271/14; 271/90

[58] Field of Search ..... 271/11, 14, 15, 12, 271/13, 90, 91–93, 98, 103–108; 414/121; 221/211

[56] References Cited

U.S. PATENT DOCUMENTS

| | | | |
|---|---|---|---|
| 1,435,205 | 11/1922 | Brigham . | |
| 2,859,964 | 11/1958 | Aronson et al. . | |
| 3,193,281 | 7/1965 | Silsby et al. | 271/11 |
| 3,226,108 | 12/1965 | Bishop . | |
| 3,265,383 | 8/1966 | Shute | 271/11 |
| 3,501,138 | 3/1970 | McGee et al. | 271/11 |
| 3,610,577 | 10/1971 | Foster . | |
| 3,614,089 | 10/1971 | Van Auken et al. | 271/104 X |
| 3,659,838 | 5/1972 | Davis | 271/11 |
| 3,674,367 | 7/1972 | Chapman . | |

FOREIGN PATENT DOCUMENTS

| | | | |
|---|---|---|---|
| 2023280 | 12/1970 | Fed. Rep. of Germany . | |
| 2043738 | 4/1971 | Fed. Rep. of Germany . | |
| 2507906 | 10/1975 | Fed. Rep. of Germany . | |
| 2737558 | 2/1978 | Fed. Rep. of Germany . | |
| 212097 | 3/1924 | United Kingdom | 271/104 |
| 1289282 | 9/1972 | United Kingdom . | |

*Primary Examiner*—Bruce H. Stoner, Jr.

*Attorney, Agent, or Firm*—Schwartz, Jeffery, Schwaab, Mack, Blumenthal & Koch

[57] ABSTRACT

A device for the automatic feeding of individual sheets from a stack of sheets to an apparatus comprises lower carrier rollers, upper feed rollers in resilient contact therewith, and a suction chamber which is displaceable in the direction of transport of the individual sheets. The suction chamber comprises a cover plate and a base plate, the base plate being designed as a perforated plate and the cover plate being provided with a suction hole for a ventilator which is arranged on the cover plate, above the suction opening.

18 Claims, 7 Drawing Figures

SHEET FEEDING DEVICE

BACKGROUND OF THE INVENTION

1. Field of the Invention

The present invention relates to a sheet feeding device for the automatic feed of individual sheets from a stack of sheets to an apparatus, the device comprising lower carrier rollers and upper feed rollers which resiliently rest against the lower carrier rollers.

2. Description of the Prior Art

Various conveying systems have been proposed for transporting an original through the treating stations of copying and reproduction machines. Thus, German Offenlegungsschrift No. 2,026,063 discloses, as part of a copying machine, a drum provided with a number of grippers arranged on and protruding from the drum suface, by which the leading edge of the original to be reproduced is clamped down.

German Offenlegungsschrift No. 2,365,228 discloses a gripping device comprising a clamping bar provided with a number of gripper fingers. The clamping bar is arranged within a drum, in a radially extending slot, and is pressed against a clamping surface in the interior of the drum by means of a system of levers actuated by an electromagnet with an armature, in order to clamp the original inserted into the slot.

The gripping device disclosed in German Offenlegungsschrift No. 2,343,133 is mounted on a revolving endless conveying system, for example two chains, and comprises a metallic gripping frame attached to the conveyor chains, movable metallic gripping jaws, and buffer cushions which prevent the photoconductive drum from being scratched or otherwise damaged by the approaching gripping device.

From German Auslegeschrift No. 1,902,112, a feeding device for copying machines is known in which the original to be copied is separated from a stack and transported, by conveyor belts, to the supporting table of an exposure station and is then deposited, also by conveyor belts, on a delivery stack. For this purpose, a first, switchable conveying system seizes the separated original and conveys it to the supporting table by means of a reversible conveyor belt driven by a reversible drive means.

The above-mentioned conveying systems comprise, as a common feature, a copy drum provided with individually integrated gripping fingers or with a rigid gripping bar extending over the surface of the drum, said fingers or said bar serving to grip the leading edge of the original being transported during rotation of the copy drum; alternatively, the original is transported by means of conveyor belts.

The above-mentioned known feeding systems are fixed components of a copying or reproduction apparatus and, by their structure and function, are unsuitable for feeding originals from the outside to the feed point of an apparatus in which the originals are to be processed.

BRIEF SUMMARY OF THE INVENTION

It is the object of the present invention to provide a sheet feeding device by means of which single sheets, which need not have the same weight, can be taken from a stack and conveyed to the feed point of an apparatus, double and multiple-draw-ins being avoided.

According to the invention, this object is achieved by means of a suction chamber which is displaceable in the direction of transport of the individual sheets of a stack and comprises a cover plate and a base plate, the base plate being designed as a perforated plate and the cover plate being provided with a suction hole for a ventilator which is arranged on the cover plate, above the suction opening.

In one embodiment of the present invention, the suction chamber is laterally limited by two perpendicular walls between which it can be displaced and each of these walls is provided with a slot extending in the direction of transport, a sliding roller and a stop roller extending from the side wall of the suction chamber into the slot being guided in each of these slots. This embodiment renders it possible to guide the suction chamber in the slots by the sliding rollers and the stop rollers, the forward movement of the suction chamber being checked by the stop rollers as soon as they reach the ends of the slots.

The side walls are connected to and extend at right angles from a horizontal supporting table on which the stack of sheets is accommodated; the length of the supporting table exceeds the depth of the side walls in the direction of transport. The supporting table extends beyond the walls in the direction of the front side of the machine, so that the entire stack rests on the supporting table.

The height of the stack which can be inserted into the sheet feeding device is determined in that the slots and, consequently, the suction chamber with the perforated base plate are arranged at a certain distance from the supporting table.

Advantageously, a mounting rod extending parallel to the supporting table is provided whose ends are supported in the side walls and a spring is fastened by one of its ends to the mounting rod and by its other end to a bolt of the ventilator housing. This spring serves as a return spring for the suction chamber, after the suction chamber has been displaced in the direction of transport. In one embodiment, the invention is so designed that on the inside of one of the walls a drive motor is mounted and that the drive shaft of the motor is passed through the wall to the outside and carries two toothed belt pulleys having different diameters. The larger of the two toothed belt pulleys drives via a belt, a toothed belt pulley mounted on a common shaft with a gear drive which drives the shaft with the feed rollers disposed at the delivery end of the sheet feeding device. The smaller of the toothed belt pulleys, also via a belt, drives a toothed belt pulley which is firmly joined to a cam and is mounted on a shaft. Advantageously, the cam rests against a cam roller positioned on the outside of the wall, on the same shaft with the sliding roller, and displaces the suction chamber, by one length of the cam in the direction of transport during one revolution, against the pull exerted by the spring. This embodiment achieves the result that the uppermost sheet of the stack attracted by the ventilator is so much advanced, in the direction of feed, that the feed rollers and the carrier rollers seize its leading edge and continue its transportation.

According to another embodiment of the invention, a drive motor is mounted on the inside of the walls and the drive shaft of the motor is passed through the wall and carries a toothed belt pulley which drives a belt transmission. This belt transmission, which is in the form of an endless link belt, is guided over a toothed belt pulley positioned on the shaft carrying the feed rollers and over another pulley which is firmly connected to the cam. This drive mechanism is simpler in construction than the drive mechanism just described.

The invention provides the further advantage that, by attracting a single sheet, and, at the same time, advancing it, a reliable and trouble-free feed of separate sheets to a machine, for example a telecopier, is ensured and the case of operation of the machine is increased by the automatic sheet feed. In the case of a telecopier, it is an additional advantage that the costs of operation can be reduced by the automatic sheet feeding device, because low rate times of the lines used for telecopying can be utilized for automatic transmission, without an operator, if the sheet feeding device is automatically actuated, for example by a timer.

BRIEF DESCRIPTION OF THE DRAWINGS

These objects, as well as additional features and advantages of the present invention will become apparent to those skilled in the art as the description proceeds with reference to the accompanying drawings, in which line numbers in the several views refer to the same elements, and wherein.

DETAILED DESCRIPTION OF THE PREFERRED EMBODIMENT

Figure 1:
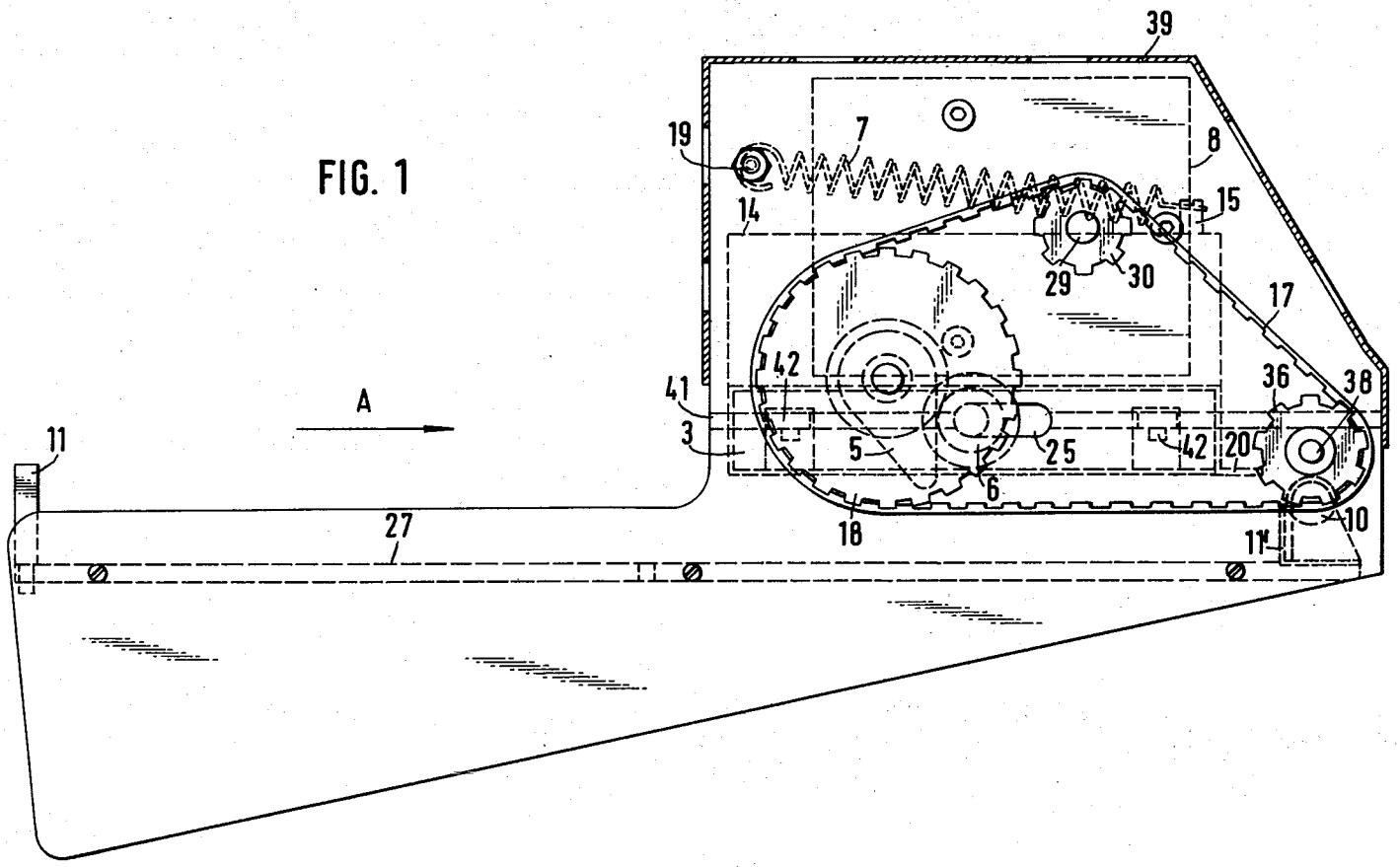
FIG. 1 is a diagrammatic side elevation of a sheet feeding device according to the invention.
Figure 2:
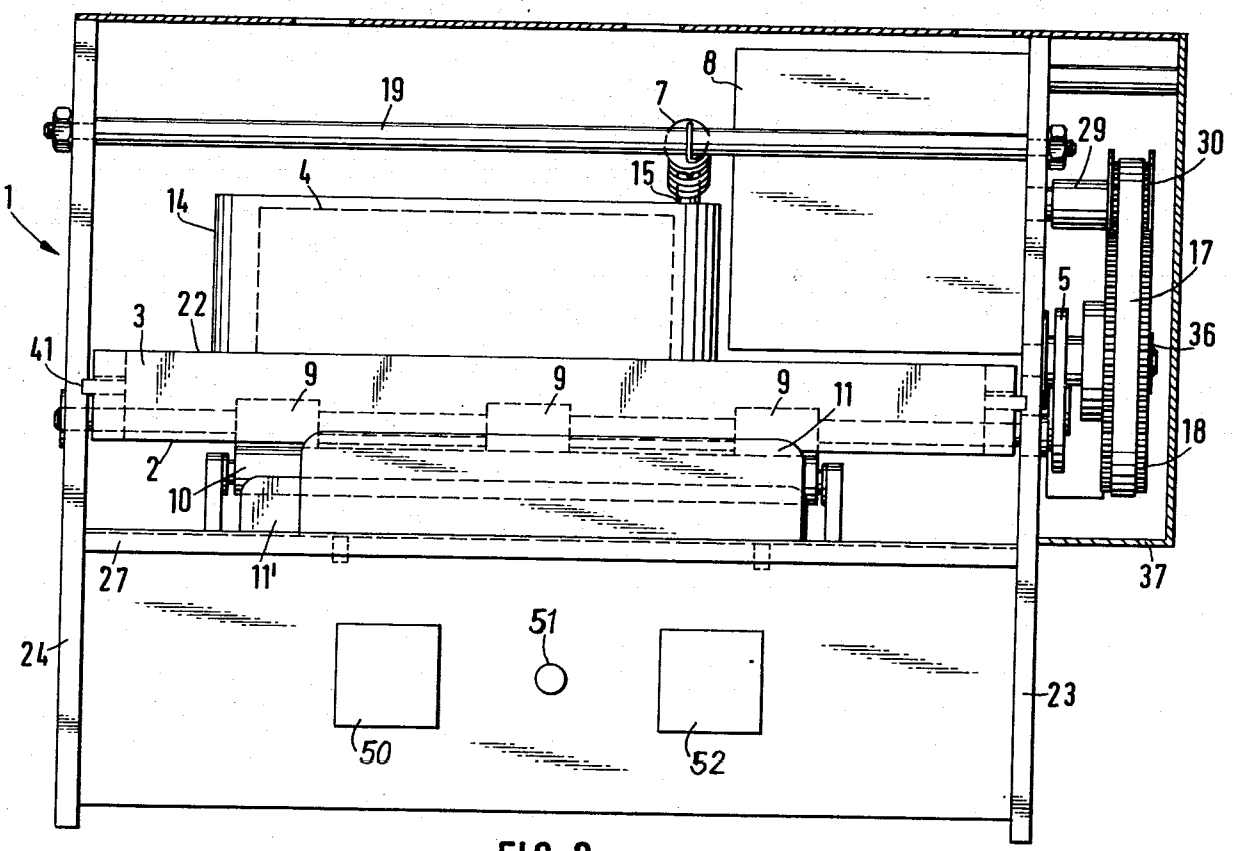
FIG. 2 is a diagrammatic front elevation of the sheet feeding device according to FIG. 1.

FIGS. 1 and 2 show, in side elevation and front elevation, a sheet feeding device 1 which comprises a suction chamber 3 which can be displaced in the direction of transport A. On the cover plate 22 of the suction chamber 3, a ventilator 4 is accommodated in a ventilator housing 14, the ventilator being connected to the electric supply system in a manner not shown in the drawing.

Figure 3:
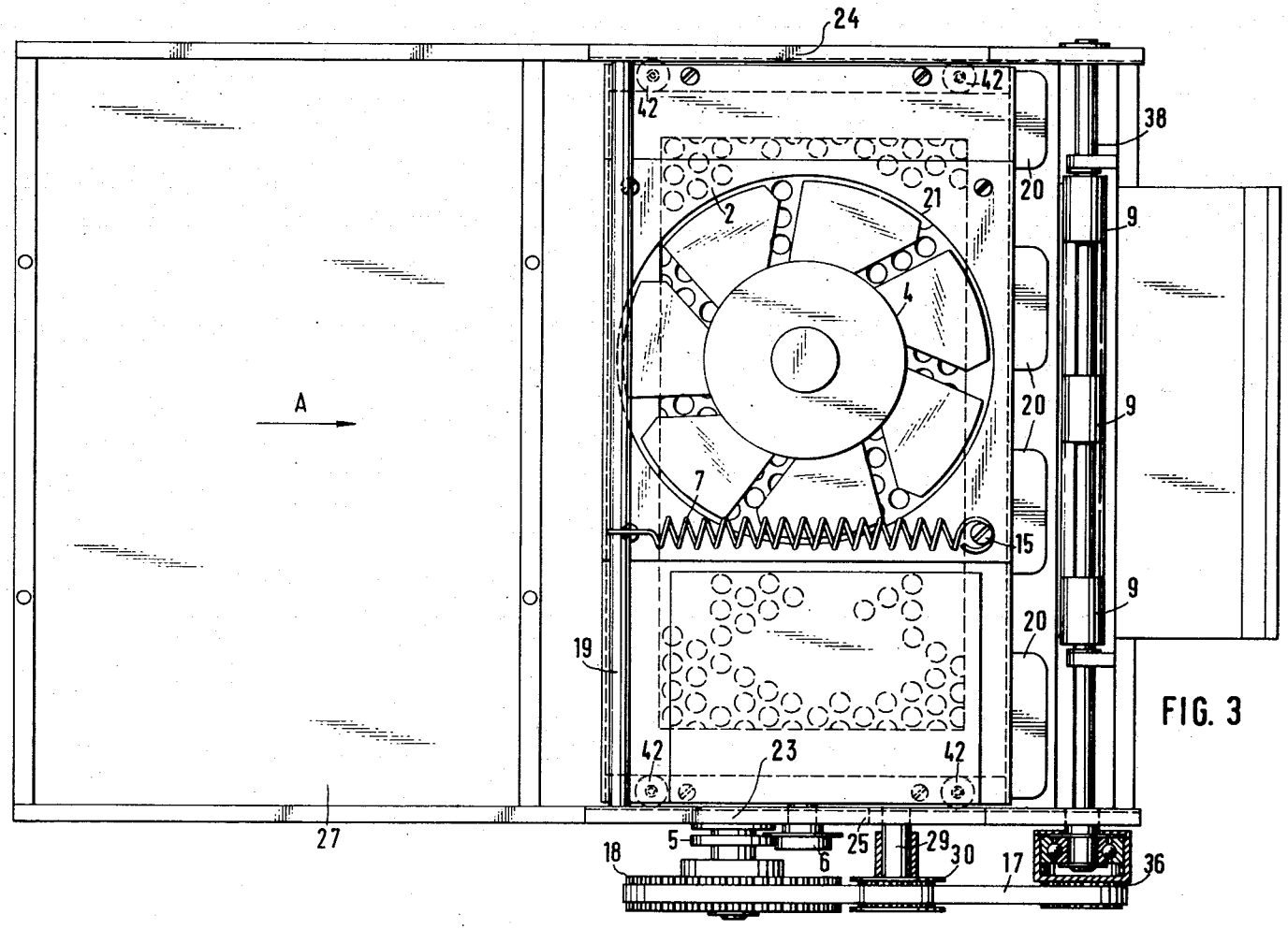
FIG. 3 is a top view of the sheet feeding device, with a partial view-through to the perforated plate of the suction chamber, which is part of the device.

As is shown in FIG. 3, the cover plate 22 comprises a suction hole 21 for the ventilator 4. The base plate of the suction chamber 3 is designed as a perforated plate 2, so that, during operation of the ventilator 4, a continuous air stream moves upwards through the perforated plate 2 and lifts the uppermost sheet 13 from the stack 16 (illustrated in FIG. 5*a*).

The suction chamber 3 is in the form of a flat box which can be displaced by moving its side walls between the perpendicular walls 23 and 24. The walls 23, 24 are connected to and form a right angle with the supporting table 27 which accommodates the stack 16 of sheets 13. The length and width of the supporting table 27 is selected in accordance with the largest format of sheets to be processed. Front and rear ends of the supporting table 27 are limited by stops 11 and 11'. Usually, stop 11' is arranged at a short distance from the rear end of the supporting table 27 and rests tangentially against the carrier rollers 10. Above the carrier rollers, a shaft 38 is provided on which spaced feed rollers 9 are arranged which are in contact with the carrier rollers 10. The carrier rollers 10 normally consist of elastic material, such as rubber or the like, while the material for the feed rollers 9 preferably is an elastic expanded plastic material.

The supporting table 27 is longer than the depth of the walls 23, 24 in the direction of transport A and extends beyond the walls 23, 24 in the direction of the front side of the device.

Figure 4:
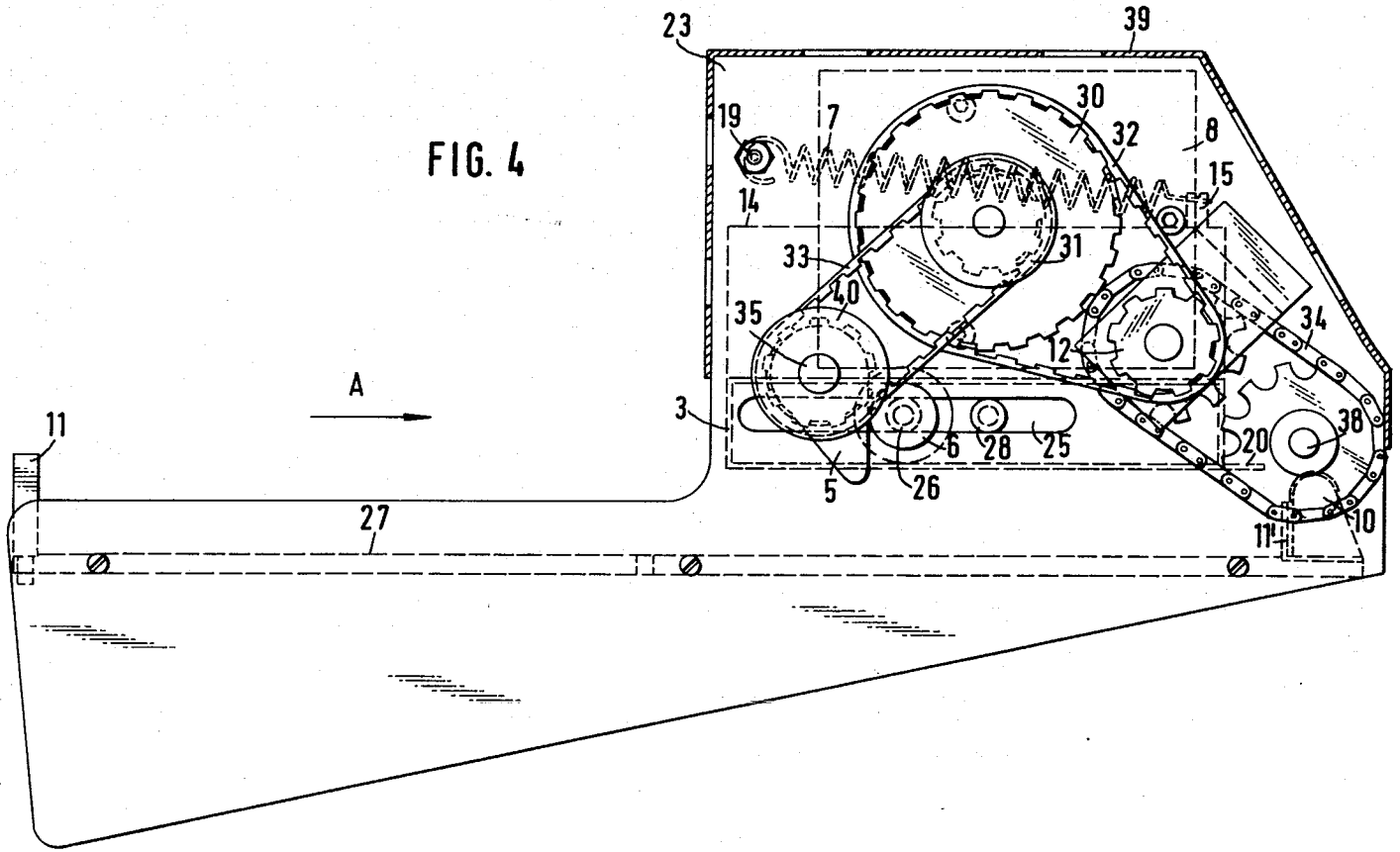
FIG. 4 is a side elevation of another embodiment of the sheet feeding device according to the invention, which is similar to the embodiment shown in FIG. 1 except that the drive system is altered.

In FIG. 4, a covering 39, which may be provided with holes, if desired, covers the sheet feeding device 1 from above, and, in the form of the casing 37, surrounds a drive mechanism for the feed rollers 9 and a cam 5, by which the suction chamber 3 is displaced in the direction of transport A.

At the front end of the sheet feeding device 1, a start button 50 and a stop button 52 are provided, between which an indicator 51, for example a lamp, is arranged which indicates the start of operation of the sheet feeding device after the start button has been pushed, and also shows the end of the sheet feeding operation.

The perforated plate 2 of the suction chamber 3 is arranged at a certain distance from the supporting table 27, said distance determining the height of the stack 16 which can be inserted into the sheet feeding apparatus.

Above the ventilator 4, and in front of it when seen in the direction of transport A, a mounting rod 19 is provided which extends parallel to the supporting table 27 and is joined by its ends to the side walls 23 and 24. For this purpose, the ends of the mounting rod 19 may be provided with threads and passed through holes in the walls 23 and 24 to the outside, where they are fastened by nuts. A spring 7 is hinged by one of its ends to the mounting rod 19, while the other end of the spring 7 is fastened to a bolt 15 on the ventilator housing 14. The spring 7, which is slightly inclined to the horizontal, acts as a return spring for the suction chamber 3 and pulls it back into its starting position after completion of its advance movement.

A drive motor 8 for moving the suction chamber 3 is provided on the inside surface of the wall 23 and the driving shaft 29 of this motor passes through the wall 23 (see FIG. 2). A toothed belt pulley 30 is positioned on the driving shaft 29 and drives the belt transmission 17. Belt transmission 17 is an endless toothed belt which is guided over a belt pulley 36 on the shaft 38 carrying the feed rollers 9 and over a further belt pulley 18; the latter is firmly attached to a cam 5. This driving mechanism can be seen from FIG. 1 in which the casing 37 shown in FIG. 2 is omitted.

As soon as the sheet feeding device 1 is switched on, i.e. when the drive motor 8 runs, the cam 5, which is in contact with a cam roller 6, is rotated and displaces the suction chamber 3, by the cam roller and against the pull of the spring 7, by one cam length from the starting position in the direction of transport A during one rotation of the cam. During its rotation, the cam 5 rests against the cam roller 6 which slides along the slot 25 as long as the diameter of the cam increases. Upon further rotation, the diameter of the cam 5 in contact with the cam roller 6 decreases again, so that the suction chamber 3 can be drawn back into its starting position by the spring 7. Simultaneously, with the movement of the suction chamber 3, the driving mechanism rotates the feed rollers 9 resting against the carrier rollers 10 and together these rollers seize the leading edge of a sheet supplied to them and convey it, for example, to the feed point of a telecopier (not shown) coupled to the delivery end of the sheet feeding device.

At the front end of the suction chamber 3 and spaced over its entire width, guide projections 20 for the sheet to be transported are provided, as can be seen from the stop view according to FIG. 3. In the advanced position of the suction chamber 3, these projections 20 rest tangentially against the lower edge of the shaft 38 and ensure an accurate gripping and draw-in of the sheet by the feed rollers 9 and the carrier rollers 10. In the embodiments of the invention illustrated by the drawings, one carrier roller 10 is shown, but it is also possible to provide more than one carrier rollers.

The guide projections 20 are arranged opposite to the section of the shaft 38 extending between two neighboring feed rollers 9, or, as the case may be, opposite to a section extending between the wall 23 or 24 and the feed roller 9 next to it. In this manner, care is taken that during the advance movement of the suction chamber 3, the guide projections 20 are located either between two feed rollers 9, or between a feed roller 9 and wall 23 or 24.

In the embodiment of the invention shown in FIGS. 1 to 3, the suction chamber 3 is guided between the walls 23 and 24 by two sliding rollers 42 (see FIGS. 2 and 3) sliding in grooves 41 on the inside of the walls 23 and 24 which extend over the entire length of these walls. The sliding rollers are horizontally mounted between the walls 23 and 24 and recesses in the side walls of the suction chamber 3, and ensure a virtually frictionless movement of the suction chamber 3.

In the embodiment of the invention shown in FIG. 4, each of the walls 23 and 24 is provided with a slot 25 which extends parallel to the supporting table 27, the slots being shorter than the adjoining side wall of the suction chamber 3. From each side wall of the suction chamber 3, two shafts protrude on which a sliding roller 26 and a stop roller 28 are mounted, which engage the slots 25 in the walls 23 and 24. The stop roller 28 checks the advance movement of the suction chamber 3 as soon as it abuts against the rear end of the slot 25. A cam 5 sits on the shaft 35 on the outside of the wall 23.

In this embodiment, a drive motor 8 is also attached to the inside of the wall 23, and the driving shaft 29 of the motor passes through the wall 23 to the outside. The driving shaft 29 carries two toothed belt pulleys 30 and 31 with different diameters, the larger of which, pulley 30, drives a belt pulley 12 by the belt 32, the pulley 12 sitting on a common shaft with the gear drive 34. The gear drive 34 comprises two sprockets which are connected with each other by a closed, endless sprocket chain. The gear drive rotates the shaft carrying the feed rollers 9 at the delivery end of the sheet feeding device 1. The smaller of the toothed belt pulleys on the driving shaft 29, i.e. pulley 31, drives, by a belt, a toothed belt pulley 40 which is firmly connected to the cam 5 and sits upon a shaft 35. By the rotation of the cam, the suction chamber 3 is displaced in the manner described above.

The mode of operation of the sheet feeding device 1 is described in more detail by reference to the diagrams shown in FIGS. 5*a* to 5*c*.

Figures 5A, 5B, 5C:
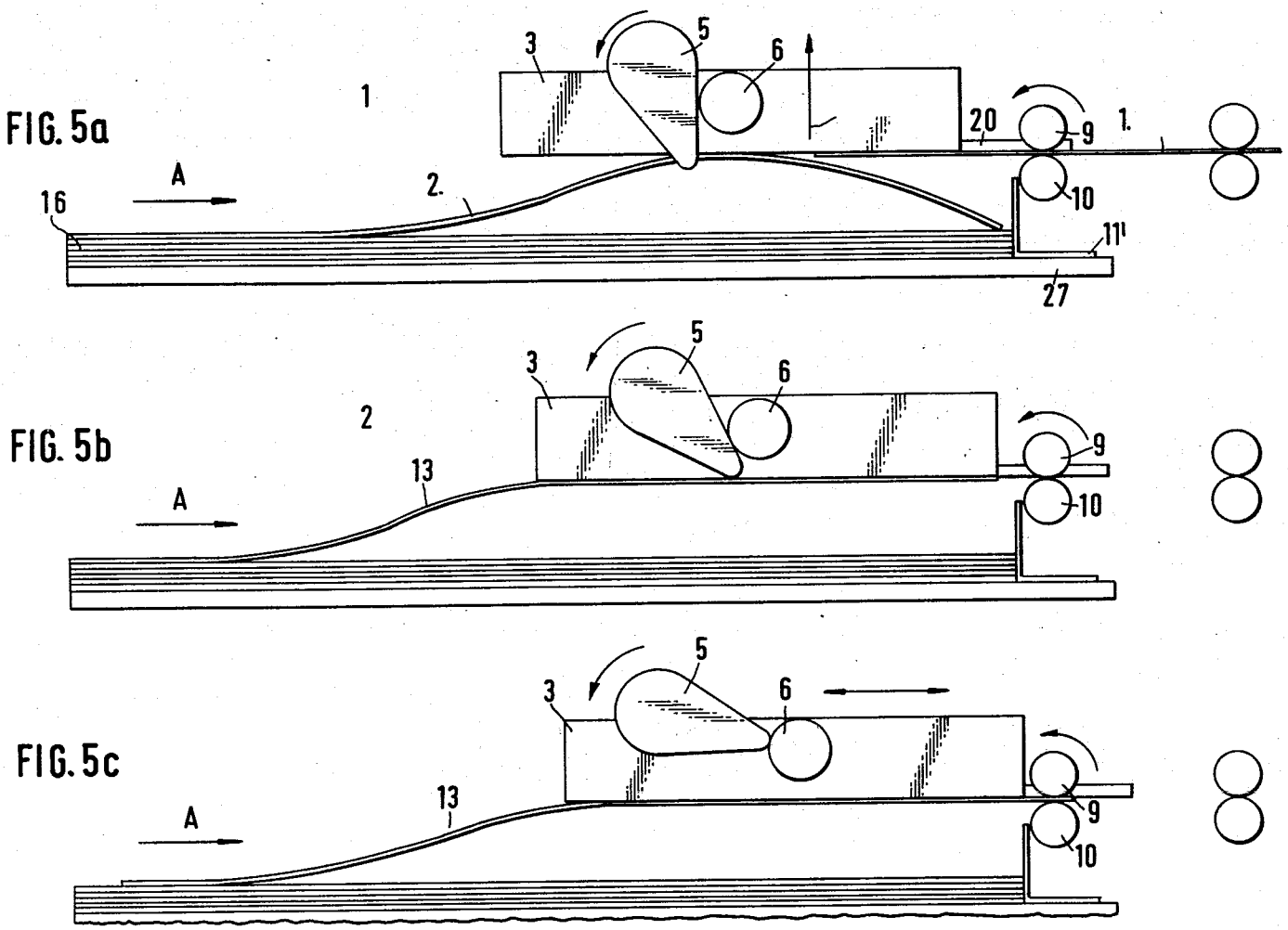
FIGS. 5*a*, 5*b* and 5*c* are diagrammatic representations of three patterns of motion during aspiration of a sheet and its movement through the sheet feeding device according to the invention.

During the suction phase 1 shown in FIG. 5*a*, a first sheet 13 of a stack 16 has been gripped by the feed rollers 9 and the carrier rollers 10 and is forwarded to the feed rollers of a machine (not shown) coupled to the delivery end of the device. Part of the perforated plate of the suction chamber 3 is still covered by the first sheet 13. A second sheet from the stack 16 is attracted by the uncovered portion of the perforated plate of the suction chamber 3 and is curved upwards. The suction chamber 3 is still in its starting position. The suction force exerted by the ventilator 4 upon the second sheet is about 70 percent of the full suction force, but continually increases as the first sheet is drawn in by the machine coupled to the delivery end of the sheet feeding device. Depending on the weight of the sheet, which may range from 30 to about 150 g/m$^2$, the second sheet is more or less curved. By the continuously increasing suction effect of the ventilator on the second sheet and by the weight of a third sheet which may follow, a separating effect is created between these two sheets which reliably prevents a double or multiple draw-in of sheets.

In the second suction phase shown in FIG. 5*b*, the perforated plate of the suction chamber 3 is entirely covered by the sheet 13 and cam 5 begins to rotate and to displace the sliding roller in the direction of transport A, thus advancing the suction chamber 3.

In the forwarding phase of sheet 13 shown in FIG. 5*c*, the suction chamber 3 has been displaced by the full length of the cam in the direction of transport A and feed rollers 9 and carrier rollers 10 have seized the leading edge of sheet 13. A continuation of the rotation of the cam 5 in the direction of the arrow (see FIG. 5*c*) causes the spring 7 to retract the suction chamber 3 to its earlier position.

The perforated plate ensures a suction over substantially the entire width of the suction chamber, with an approximately laminar air flow, and because the marginal zones are also covered, undesirable turbulences are avoided, which otherwise might cause a double or multiple draw-in of sheets.

Although the invention has been described in terms of selected preferred embodiments, the invention should not be deemed limited thereto, since other embodiments and modifications will readily occur to one skilled in the art. It is therefore to be understood that the appended claims are intended to cover all such modifications as fall within the true spirit and scope of the invention.

What is claimed is:

1. A sheet feeding device for the automatic feeding of individual sheets from a stack to an apparatus, having front and delivery ends, comprising:

(a) lower sheet carrier rollers positioned between said stack and said apparatus;

(b) upper sheet feed rollers carried on a first shaft in resilient contact with said lower carrier rollers;

(c) a suction chamber, displaceable in the direction of transport of said sheets from said stack to said apparatus, wherein said chamber comprises:

(i) a perforated base plate;

(ii) a cover plate provided with a suction opening located over said base plate; and (iii) ventilator means for providing suction to said chamber, said ventilator means being positioned over said suction opening in said cover plate;

(d) a pair of vertical walls between which said suction chamber is located; and (e) means for displacing said suction chamber;

(f) means for guiding the displacement of said chamber in the direction of transport;

(g) said means for displacing said suction chamber comprising:

(i) a drive motor with a drive shaft, wherein said motor is attached to the inside of one of said vertical walls and said drive shaft passes through to the outside of said one wall;

(ii) a pair of belt driving toothed belt pulleys, each with different diameters, carried by said shaft;

(iii) feed roller driving toothed belt pulley, driven by the larger of said belt driving toothed belt pulleys and operably connected to rotate said feed rollers;

(iv) a second shaft connected to extend perpendicularly from the outside of said one vertical wall to which said motor is attached;

(v) a cam carried by said second shaft, said cam co-operating with said suction chamber to effect displacement thereof; and (vi) a cam driving toothed belt pulley connected to said cam and driven by the smaller of said belt driving pulleys.

2. A sheet feeding device for the automatic feeding of individual sheets from a stack to an apparatus, having front and delivery ends, comprising:

(a) lower sheet carrier rollers positioned between said stack and said apparatus;

(b) upper sheet feed rollers carried on a first shaft in resilient contact with said lower carrier rollers;

(c) a suction chamber, displaceable in the direction of transport of said sheets from said stack to said apparatus, wherein said chamber comprises:

(i) a perforated base plate;

(ii) a cover plate provided with a suction opening located over said base plate; and (iii) ventilator means for providing suction to said chamber, said ventilator means being positioned over said suction opening in said cover plate;

(d) a pair of vertical walls between which said suction chamber is located;

(e) means for displacing said suction chamber;

(f) means for guiding the displacement of said chamber in the direction of transport;

(g) said means for displacing said suction chamber comprising:

(i) a drive motor with a drive shaft, wherein said motor is attached to the inside of one of said vertical walls and said drive shaft passes through to the outside of said one wall;

(ii) a first toothed belt pulley arranged to be carried by said drive shaft;

(iii) a second shaft connected to extend perpendicularly from the outside of said one vertical wall to which said motor is attached;

(iv) a cam attached to said second shaft, said cam co-operating with said suction chamber to effect displacement thereof;

(v) a second toothed belt pulley connected to said cam;

(vi) a third toothed belt pulley operably connected to rotate said feed rollers; and (vii) transmission means connected between said first, second and third pulleys to rotate said pulleys in response to the operation of said motor.

3. The sheet feeding device of claim 1, further including means for supporting the stack of sheets, and wherein said vertical walls are joined at right angles to said supporting means.

4. The sheet feeding device of claim 3, wherein said supporting means is longer than the length of said vertical walls in said direction of transport and extends beyond said walls in the direction of said front end of said device.

5. The sheet feeding device of claim 4, further including connecting means coupled between said vertical walls and extending parallel to said supporting means and including spring means, hinged by one of its ends to said connecting means and attached at its other end to said suction chamber, for returning said chamber to its starting position on said device.

6. The sheet feeding device of claim 1, wherein said means for guiding the displacement of said chamber includes a slot in each of said vertical walls extending in the direction of displacement, and wherein said guiding means further comprises a sliding roller and a stop roller, which rollers are guided by said slots and which laterally project from said vertical walls of said chamber and extend into said slots.

7. The sheet feeding device of claim 6, wherein said slots and said suction chamber having said perforated base plate are arranged at a distance from said supporting means which distance predetermines the height of said stack which may be inserted into said device.

8. The sheet feeding device of claim 2, wherein said means for guiding the displacement of said chamber includes a groove in the inside of each vertical wall extending in the direction of displacement and wherein said guiding means further comprises two sliding rollers guided by said grooves which rollers laterally project from said vertical walls of said chamber and extend into said grooves.

9. The sheet feeding device of claim 8, wherein said grooves and said suction chamber having said perforated base plate are arranged at a distance from said supporting means which distance predetermines the height of said stack which may be inserted into said device.

10. The sheet feeding device of claims 7 or 9, further including stopping means arranged at the delivery end of said device for setting the length of travel of said suction chamber.

11. The sheet feeding device of claim 10, further including guide projections for the sheet to be transported located at the front end of said suction chamber over the entire width of said sheet feeding device.

12. The sheet feeding device of claim 11, wherein at the full length of travel of said suction chamber, said guide projections rest tangentially against the lower edge of said first shaft carrying said upper feed rollers.

13. The sheet feeding device of claim 12, wherein said guide projections are positioned opposite to a section of said first shaft carrying said feed rollers with said guide projections extending between two neighboring feed rollers.

14. The sheet feeding device of claim 13, wherein said guide projections are positioned opposite to a section of said first shaft carrying said feed rollers between said vertical wall and the feed roller next to said vertical wall.

15. The sheet feeding device of claim 1, wherein said means for guiding the displacement of said chamber includes a sliding roller and means for receiving said sliding roller and directing said sliding roller along a path, said sliding roller and said receiving means co-operating with each other, said sliding roller and said receiving means being operatively coupled between a displaceable portion of said chamber and at least one of said vertical walls.

16. The sheet feeding device of claim 15, further comprising:

(a) a spring having two ends, one end of which is fixed with respect to the vertical walls, the other end of which is fixed with respect to the suction chamber;

(b) a third shaft, supporting said sliding roller, and connected to extend perpendicularly from the outside of said vertical wall to which said motor is attached in a position adjacent to said first shaft; and (c) a cam roller attached to said third shaft in contact with said cam such that rotation of said cam displaces said suction chamber against the force of said spring by one cam length from its starting position.

17. The sheet feeding device of claim 1 wherein said pair of vertical walls laterally limits said suction chamber, said means for displacing said suction chamber being for displacing said suction chamber with respect to said pair of vertical walls.

18. The sheet feeding device of claim 2 wherein said pair of vertical walls laterally limits said suction chamber, said means for displacing said suction chamber being for displacing said suction chamber with respect to said pair of vertical walls.

* * * * *